US008337296B2

(12) United States Patent
Grauzer et al.

(10) Patent No.: US 8,337,296 B2
(45) Date of Patent: Dec. 25, 2012

(54) METHOD AND APPARATUS FOR USING UPSTREAM COMMUNICATION IN A CARD SHUFFLER

(75) Inventors: Attila Grauzer, Las Vegas, NV (US); David B. Lopez, Las Vegas, NV (US)

(73) Assignee: SHFL entertaiment, Inc., Las Vegas, NV (US)

( * ) Notice: Subject to any disclaimer, the term of this patent is extended or adjusted under 35 U.S.C. 154(b) by 1762 days.

(21) Appl. No.: 09/967,500

(22) Filed: Sep. 28, 2001

(65) Prior Publication Data

US 2003/0064798 A1 Apr. 3, 2003

(51) Int. Cl.

| | |
|---|---|
| ***G07C 15/00*** | (2006.01) |
| ***A63F 1/14*** | (2006.01) |
| ***A63F 1/18*** | (2006.01) |
| ***A63F 5/02*** | (2006.01) |

(52) U.S. Cl. ..... 463/22; 463/17; 463/26; 463/29; 273/309; 273/149 R

(58) Field of Classification Search ..... 463/29, 463/9–13, 16, 25, 40–43, 46–47, 17, 22, 463/26; 273/274, 292, 309, 149 R, 149 P, 273/139, 148 A, 307, 138.1, 138.2, 144 R, 273/144 A, 144 B See application file for complete search history.

(56) References Cited

U.S. PATENT DOCUMENTS

| | | | | |
|---|---|---|---|---|
| 4,467,424 | A * | 8/1984 | Hedges et al. | 463/26 |
| 4,807,884 | A * | 2/1989 | Breeding | 273/149 R |
| 4,861,041 | A * | 8/1989 | Jones et al. | 273/292 |
| 5,288,081 | A * | 2/1994 | Breeding | 273/292 |
| 5,356,145 | A * | 10/1994 | Verschoor | 273/149 R |
| 5,586,936 | A | 12/1996 | Bennett et al. | |
| 5,605,334 | A * | 2/1997 | McCrea, Jr. | 273/309 |
| 5,613,912 | A | 3/1997 | Slater | |
| 5,651,548 | A | 7/1997 | French et al. | |
| 5,722,893 | A | 3/1998 | Hill | |
| 5,735,742 | A | 4/1998 | French | |
| 5,743,798 | A * | 4/1998 | Adams et al. | 463/17 |
| 5,779,546 | A | 7/1998 | Meissner et al. | |
| 5,781,647 | A | 7/1998 | Fishbine et al. | |
| 5,919,090 | A | 7/1999 | Mothwurf | |
| 5,989,122 | A | 11/1999 | Roblejo | 463/22 |
| 6,039,650 | A | 3/2000 | Hill | |

(Continued)

FOREIGN PATENT DOCUMENTS

| | | |
|---|---|---|
| WO | WO 97/10577 | 3/1997 |

OTHER PUBLICATIONS

Notification of Transmittal of International Preliminary Examination Report for corresponding International Application No. PCT/US02/31105, filed Sep. 27, 2002.

*Primary Examiner* — Peter DungBa Vo
*Assistant Examiner* — Bach Hoang
(74) *Attorney, Agent, or Firm* — TraskBritt

(57) ABSTRACT

A tray, serving as a transaction drawer, optimally fitted to X-ray inspection equipment for ease and efficiency of the operation. Yet, easy to handle by the operator and stackable for storage and having a test wedge to verify read outs by the X-ray machine, made out of translucent, plastic material, economically produced.

21 Claims, 2 Drawing Sheets

U.S. PATENT DOCUMENTS

| | | | | |
|---|---|---|---|---|
| 6,071,190 | A | 6/2000 | Weiss et al. | |
| 6,093,103 | A | 7/2000 | McCrea, Jr. | |
| 6,126,166 | A | 10/2000 | Lorson et al. | |
| 6,154,131 | A | 11/2000 | Jones, II et al. | |
| 6,165,069 | A | 12/2000 | Sines et al. | |
| 6,183,362 | B1 | 2/2001 | Boushy | |
| 6,186,895 | B1 | 2/2001 | Oliver | |
| 6,200,218 | B1 | 3/2001 | Lindsay | |
| 6,234,900 | B1 | 5/2001 | Cumbers | |
| 6,254,002 | B1 | 7/2001 | Litman | |
| 6,257,981 | B1 | 7/2001 | Acres et al. | |
| 6,267,671 | B1 | 7/2001 | Hogan | |
| 6,270,404 | B2 | 8/2001 | Sines et al. | |
| 6,517,435 | B2 * | 2/2003 | Soltys et al. | 463/25 |
| 6,517,436 | B2 * | 2/2003 | Soltys et al. | 463/29 |
| 6,520,857 | B2 * | 2/2003 | Soltys et al. | 463/29 |
| 6,527,271 | B2 * | 3/2003 | Soltys et al. | 273/148 R |
| 6,530,836 | B2 * | 3/2003 | Soltys et al. | 463/29 |
| 6,530,837 | B2 * | 3/2003 | Soltys et al. | 463/29 |
| 6,579,180 | B2 * | 6/2003 | Soltys et al. | 463/25 |
| 6,638,161 | B2 * | 10/2003 | Soltys et al. | 463/12 |
| 6,663,490 | B2 * | 12/2003 | Soltys et al. | 463/25 |
| 6,688,979 | B2 * | 2/2004 | Soltys et al. | 463/25 |
| 6,712,696 | B2 * | 3/2004 | Soltys et al. | 463/25 |
| 6,758,751 | B2 * | 7/2004 | Soltys et al. | 463/29 |
| 7,011,309 | B2 * | 3/2006 | Soltys et al. | 273/149 R |
| 7,316,615 | B2 * | 1/2008 | Soltys et al. | 463/25 |
| 7,390,256 | B2 * | 6/2008 | Soltys et al. | 463/12 |
| 7,686,681 | B2 * | 3/2010 | Soltys et al. | 463/11 |
| 8,016,663 | B2 * | 9/2011 | Soltys et al. | 463/22 |
| 2003/0003997 | A1 | 1/2003 | Vuong et al. | |

* cited by examiner

METHOD AND APPARATUS FOR USING UPSTREAM COMMUNICATION IN A CARD SHUFFLER

FIELD OF THE INVENTION

The present invention relates to the field of casino gaming, casino table gaming, casino table card gaming, and the tracking and monitoring of the widest possible parameters of that gaming environment.

BACKGROUND OF THE ART

The casino is probably the most controlled and secure environment frequented by people. To protect against cheating, there have been overhead walkways, floor walkers, pit bosses and other individuals acting as observers in casinos for many years. As technology has advanced, there are surveillance cameras in the casinos, at every conceivable location. These monitors have live viewers and videotaping to record evidence, and cover essentially every exposed area in a casino. The resolution on the cameras is sufficient to read the lettering on U.S. currency, even from cameras located twenty or thirty feet away.

The security objective in the casino is primarily aimed at protecting the casino against lost winnings because of cheating at the tables or slot machines. Although customers in the casino are also under surveillance to guard them against robbery or harm, the primary objective is definitely to protect the profit margin of the casino. As the profitably of play in the casino determines the bottom line of the casinos, controlling unnecessary losses is a reasonable objective.

In the play of casino table games where cards are used in play and chips or tokens are used to place wagers, two of the most significant venues for dishonesty are in switching cards, and in altering the value of chips placed as wagers. The skill of certain individuals in performing these tasks is at best difficult if not impossible to observe, the skill sometimes reaching the level of magicians in switching, palming, and adding chips and/or cards during play. Even under repeated scrutiny with video observation, the visual evidence is less than satisfactory against the most skilled cheats.

Additionally, when a dealer is operating in conspiracy with a player, the nature of the security violation can rapidly change at a table and will not be as readily observable as where the same type of illegal act is repeated. It is difficult to get physical evidence where such a conspiracy exits, as where dealer's cards are purposely exposed to provide a player with additional information, or the dealer is manipulating cards, as by withholding a group of cards from shuffling or positioning a preset group of cards so that a player will have a certain win.

Casinos are also less than thrilled with card counters at the blackjack table. Even though there are few individuals who can successfully and regularly practice this technique, and even though the skill is legal, there is evidence that a skilled card counter can win over one hundred thousand dollars per year. Card counters are identified only by specific betting traits, and these have been observed by visual inspection of the tables. To encourage higher gross levels of wagering by players, casinos often extend complimentary goods and services to players in exchange for more active wagering. This is conventionally known as "comping" and the casino operators award players "comps." Comps can be any redeemable forms of currency and/or currency equivalent typically issued (for promotional purposes) by casinos to their players in exchange for active, table game patronage. Such comps include points, club points, premium points, player club points, coupons (e.g., free meals, free rooms, free shows, free gifts, etc.), comp dollars and/or any other form of redeemable coupons, vouchers, cash rebates, goods or services.

Certain casinos offer players club cards. Players can insert the club card into a conventional slot machine and as the player plays the slot machine, tickets (or other comp credits) may be issued based upon the gross wagers made during the time the player plays the slot machine (e.g., one ticket whenever the accumulative wager equals $100). This is an example of one stand-alone comp-awarding approach wherein the comp determination and the delivery of tickets are made at the slot machine.

A player entitled to comps or attempting to earn comps identifies himself/herself upon initiation of a gambling session (i.e., the period during which the player participates actively in a form of gambling). The casino then determines the player's "gross session wager" (i.e., the total currency value put at stake by the player over the course of the gambling session). The casino multiplies the gross session wager by the house advantage (i.e., the percentage of total amount wagered that the casino can expect to win in accordance with the inherent statistical probability of a given game type), thus producing a theoretical expected win (i.e., the product of gross session wager multiplied by house advantage and usually expressed in units of currency). The casino then expresses the theoretical expected win as a currency value and multiplies the theoretical expected win by an internal percentage known as the comp factor (i.e., the percentage of the theoretical expected win, which the casino is willing to return to players in the form of complimentary goods and/or services—a typical range is fifteen to forty-five percent of the theoretical expected win), thus producing available comp (i.e., the product of the theoretical expected win multiplied by the comp factor, which may be expressed as units of currency or point equivalents). The player then requests goods and/or services in exchange for his or her play at the gaming sessions. The casino determines the value of the goods and/or services requested and the player's available comp and provided that the available comp is sufficient, the good and/or service is delivered. The available comp is adjusted to reflect the value of the good and/or service delivered.

In conventional automated game machines such as slot machines, an accurate determination of available comp conventionally occurs. The player inserts the club card into a card-reading device at the gaming machine. The processor in the gaming machine communicates with a remote game machine management system (computer) and updates the specific player file in a system database. The player conducts the gaming session at the gaming machine and, during the gaming session, the processor updates the player file with the currency value of each game. The currency values accrue within individual player files, resulting in either periodic or real-time, positive adjustments to the gross wager balance for the player. When a player requests goods and/or services, the values of gross wager and house advantage (fixed percentage in slot machines) are inserted into the theoretical expected win equation. The comp factor (configurable by the casino) is then applied to the theoretical expected win, thus resulting in an available comp for the player. The system determines the value of the goods and/or service requested, as well as player's available comp. Provided that the available comp is sufficient, the goods and/or services are delivered to the player and the available comp balance is decremented to reflect the value of the goods and/or services delivered. Typical slot management and casino management systems that operate in the manner described above are conventionally provided in the gaming industry.

When attempting to determine available comp for live card table game players, however, casinos are dependent upon human assessments of both gross wager and house advantage. As a result, casinos approximate these variables. The player notifies casino personnel of his/her presence at the game table and presents a club card. A casino employee takes the club card and inputs it at a remote terminal, thereby updating the specific player file in the table system database. The player conducts the gaming session. A casino employee, usually a pit person, surveys the player's wagering activity periodically, making handwritten assessments of the average wagers on paper slips or cards. The player concludes the gaming session and leaves. Once a casino employee notices that a player has departed, the handwritten assessments of the average wagers are summed and divided by the number of manual assessments (e.g., $75+$50+$25/3 games=$50 per game). The casino employee updates the player file with the average wager information by inputting it into the system and closes the pending gaming session for the player. The resident system establishes a gross wager by multiplying the observed average wager by session duration and a decisions per hour constant. In order to establish a surrogate measure of a player's gross wager, casinos multiply an estimated average wager by both the number of hours played and a decisions per hour constant. This constant represents the casino's best guess as to the average number of decisions made by the average player over the course of an hour. Expressed mathematically, therefore, this process appears as follows: Gross Wager ($)=Average Wager ($) X Time X Decisions Constant. These wagering values accrue within individual player files, resulting in either periodic or real-time, positive adjustments to the gross wager balance. When determining a theoretical expected win, most represent house advantage with either a "worst case" or a "middle-of-the-road" percentage. In blackjack, for example, the house advantage against a player of exceptional skill (worst case) is approximately 0.5%, whereas the house advantage over a player of poor skill may be as high as 3.0%. Although some table systems do provide for the manipulation of house advantage on an individual basis, this manipulation seldom occurs and house advantage becomes a constant in practice. The predefined comp factor is then applied to the theoretical expected win, thus resulting in available comp for the player. The resident system then determines the value of the good and/or service requested, as well as the player's available comp. Provided that the available comp is sufficient, the good and/or service is delivered and the available comp balance is adjusted to reflect the value of the good and/or service delivered.

A need exists to fully automate the player rating process at a live card gaming table in a casino to accurately rate the player and to reduce labor costs. Without question, player ratings based only on human observations are inaccurate. Supervisors can easily over-assess or under-assess a particular player's rating. Furthermore, the labor costs for the supervisors are expensive.

Systems are conventionally available to assist operators in player rating determinations. However, these systems are still dependent upon subjective assessments of time played, average wager, and house advantage. A need exists to eliminate the "subjectiveness" in these assessments.

Some systems provide automated equipment for tracking a player's betting activity. Examples of manufacturers who offer such automated equipment include a Precision Resource Corporation product, PITRAK™ (U.S. Pat. No. 5,613,912), and a Grips Systems Inc. product, GOLDEN EYE™ (WO 97/10577). These systems provide rail-based card-reading units in order to allocate accurately the length of time the player is at the gaming table. However, these systems are still dependent upon the subjective assessment of average wager and house advantage. A need exists to completely automate this feature.

A need has been recognized to reward the players comps for their gaming activity at a game table based upon an accurate determination of a player's wagering activity. A need exists to deliver room, food, and other such comps to players of table games based upon such accurate determinations.

U.S. Pat. No. 6,267,671 describes a comp rating system for a player at a game table upon which a live card game is played, the game table having a player position, the game table having a wager area at the player position, the comp rating system comprising: a player data medium, the player data medium having player identifying data, a reader at the player position, the reader obtaining the player identifying data from the player data medium when the player data medium accesses the reader, a wager having at least one wagering device placed at the wager area, each of the at least one wagering device having value identifying data, a decoder at the game table receiving the value identifying data from the at least one wagering device placed at the wager area, the decoder determining a value of the wager for each live card game played at the game table, a first computer at the game table, the first computer connected to the reader and the decoder, the first computer generating a table record containing the player identifying data, and the wager value for each live card game, the first computer determining a gross session wager value when the player data medium is removed from the reader, a player database record containing a player history record updated by the first computer, a second computer connected to the player database record, the second computer receiving the table record and the player history record from the player database record upon receiving a comp request, the second computer determining whether the comp request is available, a network including at least the second computer, a host management system, a junket agent compensation request having at least one player identification, the host management system accessing the player history record from the player database record when the player history record matches the at least one player identification in the junket agent compensation request, thereby selecting only the player history record required to compensate a junket agent.

U.S. Pat. No. 6,270,404 discloses a fully video table game system comprising systems and methods for playing live casino-type card games, in particular blackjack. The systems include a presentation unit having video displays that portray virtual playing cards and other information at gaming tables attended by live participants. Shuffling, cutting, dealing and return of playing cards are accomplished using data processing functions within an electronic game processor or processors that enable these functions to be performed quickly and without manual manipulation of playing cards. The invention allows casinos to speed play and reduce the risk of cheating while maintaining the attractive ambiance of a live table game. This system has a single table computer and possibly a central reporting computer, but also suffers from the fact that many players still prefer the use of physical cards during play of casino table games.

U.S. Pat. No. 6,257,981 describes a system for monitoring and configuring gaming devices interconnected over a high-speed network. The system can support a file server, one or more floor controllers, one or more pit terminals, and other terminals all interconnected over the network. Each gaming device includes an electronic module that allows the gaming device to communicate with a floor controller over a current loop network. The electronic module includes a player-tracking module and a data communication node. The player-tracking module includes a card reader for detecting a player-tracking card inserted therein that identifies the player. The data communication node communicates with both the floor controller and the gaming device. The data communication node communicates with the gaming device over a serial interface through which the data communication node transmits reconfiguration commands. The gaming device reconfigures its payout schedule responsive to the reconfiguration commands to provide a variety of promotional bonuses such as multiple jackpot bonuses, mystery jackpot bonuses, progressive jackpot bonuses, or player specific bonuses.

U.S. Pat. No. 6,234,900 describes a system and method for tracking the play of players playing gaming devices such as slot machines through passive identification of the players. Passive identification can be achieved by analysis of a player, such as facial image photography, infrared scan, scans of a player's iris or other features of the eye, and the like. Players provide identification information and physical recognition data is acquired as by a digital or video camera. For each player, an account file and a file of the image data is stored. When the player plays the slot machine, a camera scans the player and acquires image data that is compared to stored data to identify the player. The identified player's account file is opened and data from the device representing parameters of play, e.g., amounts wagered, is allocated to the identified player's account file for the purpose of providing comps and other benefits to the player. "Doe" image data and account files can be stored to allocate parameters for unidentified players. Further, the device acquired image data can be compared with stored image data to identify undesirables such as slot cheats or the like.

U.S. Pat. No. 6,186,895 describes an intelligent casino chip system. At least one gaming table is provided with at least one discrete player area. Each player area has a discrete betting area. Two classes of intermingled gaming chips are accepted in a stack in the discrete betting area. The gaming chip of the first class, comprising the primary wager, has a first transponder containing at least value information. The gaming chip of the second class, comprising the secondary wager, has a second transponder containing value and class information. A transceiver system located on the gaming table within the vicinity of the betting area is used to receive value signals from the first transponder and transponder value and class signals from the second transponder. These signals are conveyed to a computer system that then determines a primary wager value of the primary wager based on the value signals from the first transponder. The computer system also determines the secondary wager value as distinct from the primary wager value based on the value and class signals from the second transponder. Thus, the computer is provided with the respective wager values and the distinct class of the secondary wager when the primary wager and the secondary wager are intermingled within the discrete betting area. Similarly, U.S. Pat. No. 5,781,647 describes a computer implemented gambling chip recognition system having the ability to capture an image of a stack of gambling chips and automatically processing the image to determine the number of chips within the stack and the value of each. The system processor determines the classification for each chip in a stack by way of processing performed in real time on the image of the stack of gambling chips. The system further includes the ability to communicate the information derived from the stack of gambling chips to a video monitor and the ability to communicate the information to a main database where information is being compiled and stored about an individual gambler.

U.S. Pat. No. 5,735,742 also describes a chip-tracking system wherein a fully automated accounting system accurately and automatically monitors and records all gaming chip transactions in a casino. The system employs a gaming chip having a transponder embedded therein and has an ongoing and "on-command" ability to provide an instantaneous inventory of all of the gaming chips in the casino, including those in storage in the vault as well as the chips in the cashier's cage and at each gaming table on the casino floor. The system is capable of reporting the total value of the gaming chips at any location, as well as the value of any particular transaction at any gaming table or at the cashier's cage. Optionally, the transaction history of each chip may be maintained in a database embedded in the chip (or alternatively in a central computer), and read each time the gaming chip is scanned by a special antenna. If the chip is not where it is supposed to be according to its recorded transactional history (for example, a vault chip shows up on a gaming table without having passed through the cashiers cage), it will be identified and may be invalidated by nullifying a special casino security code. U.S. Pat. No. 5,651,548 describes a system whereby radio signals or RF responses from individual chips are tracked throughout a casino. U.S. Pat. No. 6,200,218 describes a chip-tracking system in trays on a casino table.

U.S. Pat. No. 6,183,362 describes a system and method for implementing a customer tracking and recognition program that encompasses customers' gaming and non-gaming activity alike at a plurality of affiliated casino properties. Customer information is accumulated at each affiliated casino through one or more LAN-based management systems, updated to a central patron database (CPDB) that is coupled to each casino LAN through a WAN, and made available to each affiliated casino property as needed. Customer accounts are automatically activated and provided with data from the CPDB when a customer from one casino property first visits an affiliated casino property. Customer accounts are updated with new activity data whenever a management system associated with the casino receives customer data from input devices, such as card readers, workstations, and dumb terminals, located at various venues throughout the casino. Customers are awarded points, based on their tracked activity at all affiliated casino properties. The point awards have a monetary value and are redeemable for gifts, meals, cash and the like, at any of the casino properties. The point awards may embody different promotional schemes in which point awards are adjusted to target different casino properties or different venues within a casino. Summary customer data, including point levels, is regularly updated to reflect ongoing customer activity at the casino property. This data is made available to employees at any affiliated casino property, as needed, to personalize customer services.

U.S. Pat. No. 6,165,069 describes a system and method for playing live casino type card games, in particular blackjack. The systems include a presentation unit that has video displays that portray virtual playing cards and other information at gaming tables attended by live participants. Shuffling, cutting, dealing and return of playing cards are accomplished using data processing functions within an electronic game processor or processors that enable these functions to be performed quickly and without manual manipulation of playing cards. The invention allows casinos to speed play and reduce the risk of cheating while maintaining the attractive ambiance of a live table game.

U.S. Pat. No. 6,154,131 describes a system of sensors to prevent cheating at a casino gaming table, where the sensors are strategically positioned about a casino gaming table to monitor the movement about certain established areas on the gaming table during certain established times during the play of the game. The tripping of a sensor in response to the detection of unauthorized movement about a certain area of the table sends a signal to a monitoring system, which, in turn, alerts the casino so that the casino may respond to the unauthorized movement accordingly. The system of sensors can be used with a wide variety of card-based or chip-based casino gaming tables.

U.S. Pat. No. 6,126,166 describes a system for monitoring play of a card game between a dealer and one or more players at a playing table, comprising: (a) a card-dispensing shoe comprising one or more active card-recognition sensors positioned to generate signals corresponding to transitions between substantially light background and dark pip areas as standard playing cards are dispensed from the card-dispensing shoe, without generating a bit-mapped image of each dispensed standard playing card; and (b) a signal processing subsystem adapted to: receive the transition signals generated by the active card-recognition sensors; determine, in real time and based on the transition signals, playing card values for the dispensed standard playing cards; and determine, in real time, a current table statistical advantage/disadvantage relative to the players for playing cards remaining in the card-dispensing shoe.

U.S. Pat. No. 6,093,103 describes a secure game table system, adapted for multiple sites under a central control, for monitoring each hand in a live card game. A common deck identity code is located on each card. A shuffler has a circuit for counting the cards from a previous hand that are inserted into the shuffler and which reads the common identity code. The game control verifies that no cards have been withdrawn from the hand by a player or that new cards have been substituted. A unique code also placed on each card is read as the card is dealt to indicate the value and the suit. The game control stores this information in a memory so that a history of each card dealt is recorded. Sensors are located near each of the player positions for sensing the presence of a game bet and a progressive bet. A card sensor located near each player position and the dealer position issues a signal for each card received. The game control receives these signals and correlates those player positions having placed a game and/or progressive bet with the received cards. The game control at each table has stored in memory the winning combinations necessary to win the progressive jackpots. Since the game control accurately stores the suit and value of each card received at a particular player position, the game control can automatically detect a winning progressive combination and issue an award signal for that player position.

U.S. Pat. No. 6,071,190 describes a gaming device security system that includes two processing areas linked together and communicates critical gaming functions. These functions are communicated via a security protocol wherein each transmitted gaming function includes a specific encrypted signature to be decoded and validated before being processed by either processing area. The two processing areas include a first processing area having a dynamic RAM and an open architecture design, which is expandable without interfering or accessing critical gaming functions, and a second "secure" processing area having a non-alterable memory for the storage of critical gaming functions therein. The gaming machine may comprise, in combination: a first processor having open architecture including internal alterable program storage media, a visual display coupled thereto visually accessible to a player and a communication interface; a second processor having a secure processing area and having means for retaining regulatory validation, a static, non-volatile random access memory, a non-alterable read only memory and means for sending encrypted communicating data to the first processor via the communication interface, the second processor having means for sensing wagering activity and means for transmitting a random gaming outcome to the first processor to be posted on the visual display, the second processor provided with means to bestow credits as a function of the random gaming outcome.

Many different card delivery shoes and shuffling devices have been disclosed in which card-reading capabilities are provided, and by intuition or estimation, hand-reading capability has been provided. An example of that type of apparatus is found in U.S. Pat. No. 6,039,650. That patent discloses a playing card dispensing shoe apparatus, system and method wherein the shoe has a card scanner that scans the indicia on a playing card as the card moves along and out of a chute of the shoe by operation of the dealer. The scanner comprises an optical-sensor used in combination with a neural network that is trained using error back-propagation to recognize the card suits and card values of the playing cards as they are moved past the scanner. The scanning process, in combination with a central processing unit (CPU), determines the progress of the play of the game and, by identifying card counting systems-or basic playing strategies in use by the players of the game, provides means to limit or prevent casino losses and calculate the theoretical win of the casino, thus also providing an accurate quality method of the amount of comps to be given a particular player. The shoe is also provided with additional devices that make it simple and easy to access, record and display other data relevant to the play of the game. These include means for accommodating a "customer-tracking card" that reads each player's account information from a magnetic strip on the card, thus providing access to the player's customer data file stored on the casino's computer system and one or more alphanumeric keyboards and LCD displays used to enter and retrieve player and game information. Also included are keyboards on the game table so that each player can individually select various playing or wagering options using their own keyboard. U.S. Pat. No. 5,722,893 also describes a shuffler/shoe with card-reading capability.

U.S. Pat. No. 5,919,090 describes a method and apparatus for determining the win or loss of individual participants in a game of chance, such as, for example, blackjack, poker, or the like, wherein the bet and the winnings are represented by chips. A central chip depository is provided for receiving the game inventory and the latter has means for determining its momentary content. At least one chip deposit area is provided per participant and has in each case at least one sensor for the detection of chips lying on the deposit area. The means for determining the momentary chip content and also the sensors have their outputs connected to the inputs of a data processing system.

U.S. Pat. No. 5,613,912 describes a complex player-tracking system in which there is automatic tracking of the betting activity of casino patrons at gaming tables and providing an indication of this betting activity to casino personnel in real time. Casino patrons use magnetic cards to check themselves in and out of the bet-tracking system through magnetic card readers located at each betting position of a gaming table. Customer identity and location codes are coupled from the gaming table to a computer system using a wireless communication network. The computer system uses the codes to retrieve customer information, to estimate an average bet for the patron based on the current minimum table bet for the gaming table and the time period of the patron's play, and to calculate periodically an average theoretical win based on the patron's play. This information is made available through the casino computer system to casino personnel at the patron's gaming table and at any other gaming table to which the patron moves. The information available to the casino personnel is updated periodically to reflect the patron's accumulated betting activity. Similarly, U.S. Pat. No. 5,586,936 describes an automated gaming table tracking system for a gaming table, such as blackjack. A sensor located in the dealer's card playing area senses the start and end of each game. A unique player identity card is given to each player that contains information on the player. When a player arrives at a player position on the table, the player inserts his player identity card into a player station control at the player position. A central distribution control is connected to each player station control for determining the start and the end of each game and beginning and termination of play by each player at each position. A host computer is then interconnected to the central distribution control for storing the player identity information and the player position for each player station control, the start and end of each of the games, and the beginning and termination of play at each player position from the central distribution control. The host computer prints a player-tracking card. The floor supervisor observes the player during the game and fills out the in-session gaming information. Once the player leaves the table, the player-tracking card with the in-session gaming information filled out is then placed in an automatic reader so that the read in-session gaming information is stored in a data base corresponding to the identity of the player.

The LET IT RIDE BONUS® poker system is one commercial system that provides live table game security. The system includes a general-purpose game computer (typically shared by multiple tables), a programmable keypad computer and an intelligent card shuffler. Each computer component, however, has limited communication capacity among each other and the intelligence of the shuffler has been limited. A description of the components and their operation is provided below as an admission of prior art.

Keypad Computer and Controls: a player achieves a preselected winning bonus hand, the dealer inputs this information into a keypad controller. The keypad allows the dealer to start/end a game. The keypad controller receives signals from the side bet detectors (e.g., sensing that a side bet has been placed) and transmits the information to the central game computer. The keypad controls verify security keys. Physical "keys" are inserted by the dealer into the keypad controller as an extra security measure prior to paying a large payout. Often, the pit boss carries the keys and must physically verify the hand and payout before the key is used. The use of the "key" system allows verification of selected high-ranking bonus hands (i.e., a royal flush). When a winning bonus hand is achieved, the dealer inputs the position number of the winning hand into the keypad. The keypad computer verifies that an original bonus bet (side bet wager) was registered to that position. Chip sensors in the table area associated with the side bet wagers communicate with the keypad only. The keypad controls currently can communicate over fiber optic or copper cables to the game computer. The keypad computer can communicate with other hardware devices (such as a progressive meter, CRS (card revelation monitor system for display of symbols such as a card to be matched or indication of a wild card) system, with a random number generator or a sign. During setup, the keypad computer can be programmed for different games, pay tables, etc. During setup, the keypad computer is set to select music (on/off) that may indicate a bonus award. The keypad sends this information to the game computer, and the game computer controls the audio system.

Shuffler: The currently marketed technology permits the shuffler to communicate only with the keypad controller. The shuffler tells the keypad in real time how many cumulative hands have been dealt. Misdeal information is also transmitted from the shuffler to the keypad. The presence of the shuffler is verified by sending a signal to the keypad controller. The keypad controller continually polls for the presence of the shuffler. Once the presence of the shuffler is confirmed, control of some aspects of shuffler operation (such as when to deal cards) is taken over by the keypad controller. The keypad computer tells the shuffler when it is time to deal another round, and tells the shuffler when all bets have been placed and dealing can proceed.

General Purpose Game Computer: This computer is typically shared by multiple tables. It receives no information from the shuffler. It receives online/offline status of a game from the keypad controller. Key code information (to verify a high-ranking winning hand) is verified on the central computer. The central computer assembles reports of data, including the number of hands/bets/rounds (or games), game identification (that is, what game is being played on the shuffler), table identification (that is, which table is being used), bonus hands won, win/(unit time), hands/(unit time), and bets/(unit time).

Each of these areas of security and capabilities at casino gaming tables have been independently provided, or provided as grouped features. The failure to appreciate the interrelationship of some of these individual tasks and the failure to integrate them into a single piece of table game equipment has weakened the overall benefit to the casino.

SUMMARY OF THE INVENTION

A secure casino table gaming system and method of use that is designed to maximize casino security with regard to play of the table game comprises a multicomponent, multi-intelligence set of components that communicate in real time to assess the many facets of events that occur at a gaming table. The assessment provides evidence of the occurrence of significant events and provides a complete record of events in play at a table, significantly reducing the opportunity for individuals or groups to cheat at a gaming table without being observed.

At a minimum, at least two and preferably at least three microprocessors (computers, or other intelligent apparatus) are associated at a casino table with a card game. One microprocessor is specifically associated with a shuffling and/or randomizing/dealing apparatus (generally referred to herein as "shufflers" and, e.g., Shuffle Master Inc.'s ACE®, KING®, and other newly developed shufflers) to provide real time information including at least some of (and preferably all of) the number of cards that have been shuffled, the authenticity of cards in the shuffler, the number of times that a shuffling sequence of complete shuffle has been performed, the rank and value of specific cards being fed out of a section of the shuffler, the number of cards in the shoe (the delivery section of a shuffler), the rank of specific hands provided to each player, and the like.

Another microprocessor and/or game computer is directed toward game control function and is referred to herein as the table game controller or table game microprocessor. The table game controller identifies game functions and preferably includes some or all of wager amounts (provided by detectors, such as weight sensitive detectors, scanning detectors, manual input, proximity detectors, RF reading from embedded signaling systems, etc.), entry and/or recognition of side bet wagers, amounts wagered on side bets (e.g., from detectors), presence of a player at specific positions, identity of a player at specific locations (from a player-tracking system), wagering activity at a position, results of each game (based on information fed to it from the shuffler microprocessor or from a table scanner), the frequency of wins at specific positions, the frequency of bonus or jackpot events, and the like.

The third possible microprocessor (or the functions that must be combined in the performance of one or both of the other microprocessor already described) include player identification, dealer identification, betting pattern recognition software, betting pattern recordation, win/loss records and real time tallies, time of play and play rates and wagering rates, table identification, game histories, play histories, play versus time of day data, replacement times of dealers, replacement times and status of shufflers, and the like. This information can be compared and evaluated in real time, with real time communication among all of the microprocessors, to signal the occurrence of unusual events, track players, track dealers, track margins at tables, and identify a whole range of events that are desirable in maintaining casino security.

DETAILED DESCRIPTION OF THE INVENTION

Figure 1:
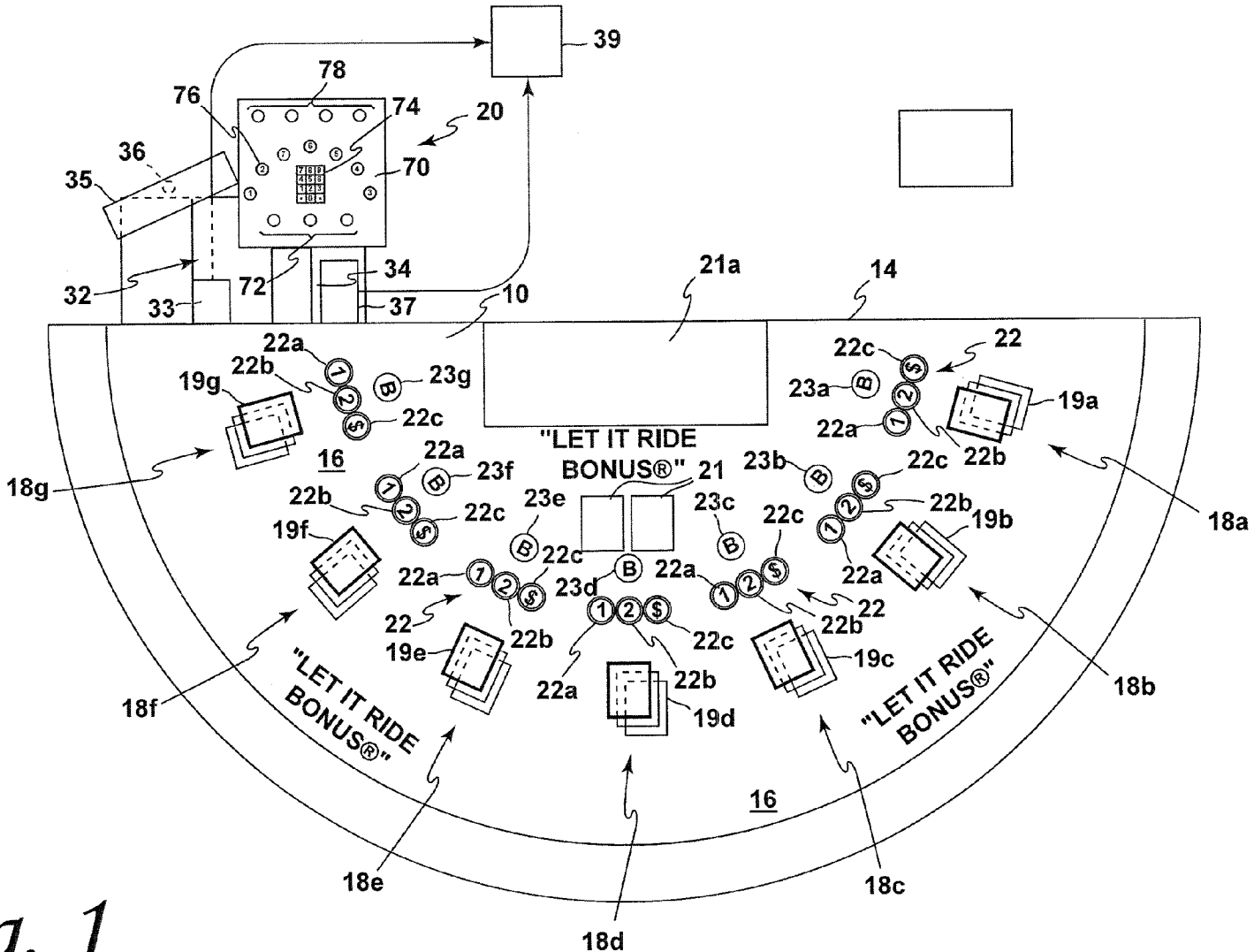
FIG. 1 shows a casino card gaming table configured to play LET IT RIDE BONUS® stud poker according to one aspect of the present invention.
Figure 2:
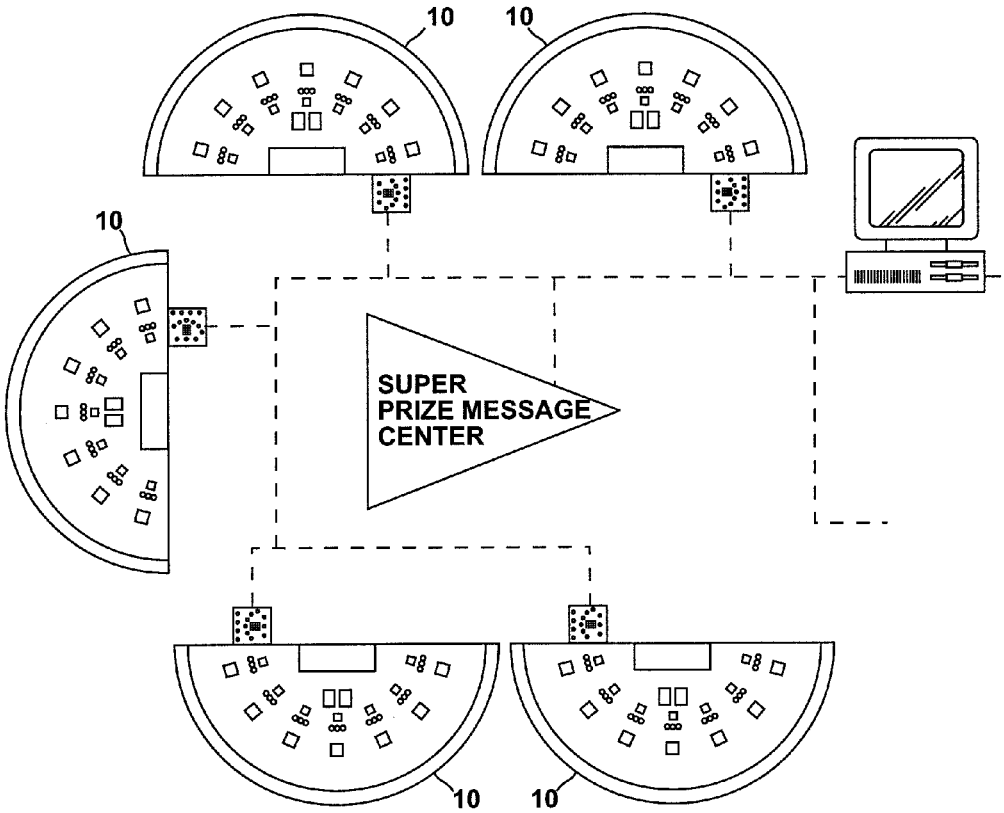
FIG. 2 shows a series of casino card gaming tables configured to play LET IT RIDE BONUS® stud poker and communicating with a single central computer according to one aspect of the present invention.

The card table game monitoring and security apparatus of the present invention comprises at least two distinct computers, preferably at least three computers associated with specific elements and communicating in real time. The system of the present invention includes a main table game controller, and will have a shuffler with its own intelligence and a keypad without its own intelligence, communicating directly with a main table game controller and possibly other table game controllers. The table game controller communicates with a main controller. The main controller is a general purpose computer and collects data from a group of game tables and/or groups of games and their tables in real time. In one form of the invention, the table game controllers share information and are in direct communication, or communication through the central controller. Typically, multiple table games of the same or of a different type are connected to the main controller. The main controller in the practice of this invention receives data from each of the table controllers, including player tracking, betting information, card identification, dealer information, player information, table location, and on a progressive system, the shared progressive amount.

The system and its use may be variously and generally described as a method of controlling a live casino table card game; comprising: sensing wagers by players at least two player locations and communicating the sensing to a table game control computer in real time and communicating the sensing to a central control computer in real time; controlling an automatic card-shuffling device with a microprocessor in the card-shuffling device and communicating information relating to card shuffling to the game table controller computer in real time and to the central control computer in real time; and electronically measuring betting information and transmitting information to the central game controller computer in real time, the electronic measuring including use of data transmitted to the central game controller computer from the table game controller computer and the shuffler.

Alternative general descriptions include a method of controlling a live casino table card game; comprising: providing a live gaming table with at least two player locations and at least one sensor in each player location for sensing bets; providing a computer controlled automatic card-shuffling device; providing a table game controller; and providing a central game controller; electronically measuring betting information, wherein the card-shuffling device receives game related data from and/or transmits data to the table game controller in real time and wherein the table game controller transmits and/or receives game related information in real time to and/or from the central game controller.

Another aspect of the invention includes an automatic card shuffler, comprising: a programmable controller, a card-randomizing mechanism and a data port, wherein data is fed from outside the card shuffler via the data port into the programmable controller from a central game computer and/or table game computer, and/or data collected by the controller is fed outside the card shuffler via the data port to a central game computer and/or table game computer.

A still further aspect of the invention is a security system for a casino table card game comprising: a) a casino table with i) indicia thereon for the placement of wagers, ii) a data entry system with an associated computer, and iii) sensors that can detect the placement of at least one specific category of wager; b) a shuffling device with a microprocessor integral to the shuffler for providing information regarding cards or hands; c) a central table gaming computer that receives information from the shuffler in real time, receives information from the sensors, and receives information from the data entry system, the associated computer, the microprocessor and the central table gaming computer communicating data among each other in real time.

The table controller will allow tracking of at least the dealer identification, the dealer efficiency and/or productivity, table usage/idle time, table location and identification, dealer errors/cheating, chip tray accounting, multi-denomination betting tracking, universal (multiple different games) progressive table games, player activity, player strategy, player win/loss activity, card counting activity, player identification (although this can be specifically performed by the main controller, as may some of the other activities, even at this stage of development), etc.

Examples of the types of data that can be captured with this system include:

- Hands dealt per unit time,
- Identification of when a service call should be made.
- Automatic service call generation.
- Jam detection/recovery and reports of jams/clears in real time to main controller.
- Rounds of play/unit time.
- When cards are scanned for rank/suit, the value of the hand can be automatically ranked and the payout can be displayed, eliminating dealer errors.
- When cards are scanned for rank/suit and the correct payout is displayed, reports of dealer error/cheating are generated when wrong payouts are made.
- The signal from the bet sensors may be input into the shuffler itself to enable the shuffler to deal only the number of hands needed to cover the bets, speeding play of the game.
- The signal from the bet sensors can be transmitted directly to the central controller to collect betting data.
- The table controller will communicate with the player-tracking system, permitting the system to measure player bets placed, player efficiency (how far the player deviates from "optimal" strategy), time at the table, frequency of visiting property, etc.

The table controller will continually pole the chip tray to verify that the correct number of chips is in the tray. Count of chips on the table can also be determined by sensors and included in the total count. Balances are fed to the central computer in real-time so that errors in paying are detected immediately.

Data on the amount of time the table is in use, the time of day the table is in use, the table i.d. number, the table location, the times when the tables are most filled and the times when the most bets are made may be collected by the table controller and transmitted to the central controller so that management can optimize usage of personnel, the arrangement of equipment and choice of games/equipment. Management can determine when table should remain open, and when it should be closed.

Data on a hand pitched game vs. the same game dealt through an automatic shuffler (at equivalent locations in terms of table usage/minimum and maximum bets, etc.) can be compared to measure productivity improvements gained through automating a table or automating the shuffling process.

Dealer identification number or name may be input into the table controller at the beginning of a shift. The dealer can be asked to sign out at the end of shift, resulting in verification of hours worked and associated data collected during this period of time with a particular dealer. Data can be used to detect dealer cheating, dealer training needs and for implementing dealer recognition awards and special compensation for rewarding and/or recognizing exceptionally good dealers that are reflected in higher holds and longer retention at the table.

An identification number corresponding to the shuffler can be input into the table controller to track the location of each shuffler. This i.d. information can also be transmitted to the main controller directly from the shuffler or into the table computer and then to the main controller.

Reports on shuffler swap outs (replacements when performance of a shuffler is less than optimal) can be generated, to assist service personnel in servicing the right shufflers, and to improve the chances that back-up units are in working order.

The central controller will generate reports such as rounds of play/shift, the number of players/shift, the average amount of time spent at the table/player, the handle, player reports that assist management in determining rating of a player, analysis/reports to use for player comping, etc.

The table controller can be programmed so that it will alert the dealer and pit boss via the central controller that a card counter is playing on the table. When the system is reading the rank and value of each card, the table controller will know the count of each hand. If player bets increase when the shoe is rich in ten value cards, the system will alert the dealer and management that the player is counting cards.

Data collected at each table controller can be transmitted in real time to the central controller, allowing management to thwart card counting, cheating schemes, dealer mistakes, etc., as the events occur.

In FIG. 1, is set forth a system of the present invention for a game table 20 on which a live card game is played. The system of the present invention can be applied to any of the following conventional game tables: baccarat and variants such as grand baccarat, mini baccarat, midi baccarat, baccarat chemin de fer and puncto banco; blackjack and variants such as progressive twenty-one, triple-action blackjack, super seven's blackjack, Spanish twenty-one, vingt et un and pontoon; big wheel, big six and variants, craps and variants, in between and variants such as red dog and catch-a-wave; poker and variants such as CARIBBEAN STUD POKER™, Caribbean draw poker, LET IT RIDE® poker, tres card poker, pai gow poker, and wheel and deal; roulette and variants such as American roulette, THREE CARD POKER®, French roulette, single zero roulette and twin roulette; and sic bo. The form, type, and variation of the game on table 10 is immaterial to the teachings of the present invention and does not limit the teachings contained herein.

The game table 10, in one general exemplary embodiment, is adapted for LET IT RIDE BONUS® stud poker and, in FIG. 1, seven player positions 18*a* through 18*g* are shown. At each player position 18*a* through 18*g* is a card position 19*a* through 19*g*, respectively, and three individual player betting positions 22*a*, 22*b* and 22*c*. A side bet (e.g., jackpot or bonus) wagering position 23*a* through 23*g* is shown at each player position 18*a* through 18*g*. A position for the dealer's cards 21 is shown in front of the dealer's position 21*a*.

A card-shuffling or card-randomizing device 32 is provided on, next to or beneath the upper surface of the table 10. The shuffling device 32 preferably has its own separate computer/microprocessor 33 integral with or electronically associated with the shuffling device 32. The table controller 37 controls the operations of the shuffler in another example of the invention. A card delivery shoe 35 is shown, from which shuffled cards, randomized cards, randomized hands or shuffled hands (not shown) are provided to the dealer to distribute. A card reader sensor 36, as indicated by dashed line, is shown within the card delivery shoe 35, although it may be positioned elsewhere within the card shuffling or card randomizing device 32, as is well known in the art. A sensor or sensors (not shown) may also be positioned on the table 10 so that cards are read and information provided to one of the computers (33, 37 and 39, or as later identified) to provide information for analysis. The game computer 37 or game controller is associated with a keypad system 20. The keypad system includes a housing 70 bearing a keypad 74 (supported by attaching element 34 to the table 10) for entering data, various rows of buttons 72 and 78 for inputting data, and player position indicator buttons 76 for assigning data input to specific player positions (although other identification systems for individual player positions are within the choice of the ordinarily skilled artisan). The side bet wagering positions 23*a* through 23*g* are provided with sensing or counting devices bet detection devices B at the side bet wagering position sites 23*a* through 23*g*. In a preferred form of the invention, the base game bet sensors located at player betting positions 22*a*, 22*b*, 22*c* are also equipped with electronic bet sensors and/or counting systems.

The bet detection devices B (as well as the devices located at player betting positions 22*a*, 22*b* and 22*c*) may be any sensing system such as, but not limited to a proximity detector, magnetic card reader, photo-optic or acoustic detector, RF responsive indicator/sensor, optical scanner, weight sensing device or the multiple security system as described in U.S. Pat. No. 6,254,002. The card reader sensor 36 is shown to be located in the shuffling device 32 of FIG. 1 on the game table 10, but could also be located on the surface 16 of the table 10 or any suitable location including in the shoe element 35 of the shuffling device 32, inside the shuffling device 32 when cards are moved one at a time within the shuffling device 32, or in any other strategic location near the gaming table 10.

Any commercially available card reader, especially those adapted for the gaming industry, could be utilized under the teachings of the present invention to read player data, available credit and any other information carried on player-tracking cards. Each card reader may form part of an array of card readers that are responsible for the collection of programmed data present on a card-based magnetic strip or in reading the images or other data on the cards. The present invention is not limited to magnetic or bar code card readers and it is to be expressly understood that the card utilized could be a smart card and that the device could write data into a smart card. Furthermore, any equivalent device could be utilized under the present invention, which at least reads player identification data from a data medium carried by the player.

The game table computer 37 serves as an intelligent processor and communications hub for the game table 10. The game table computer 37 contains software and coordinates all recognition, display, mathematical, diagnostic and communication routines and functions associated with the transfer of data between itself and the other table-based and distal components as will be explained in the following. The table-based computer 37 also interfaces with computer-based systems (e.g., 33 and 39) remote from the game table 10, and in one example of the invention, also communicates with other table-based computers on the property, or between properties via a network connection.

In FIG. 1 is also a dealer's keypad system 20 at dealer location 14 that serves as a communication device between the dealer and the system of the present invention. It enables the dealer to enter commands and/or selections of commands from predefined menus. Also at the dealer location 14 may be a dealer visual interface (not shown, may be located on the table 10 or on the shuffling device 32) that displays game information, chip tray inventories, personnel identification, casino chip values, and values summed by player positions 18*a* through 18*g*. In addition, component status and/or miscellaneous messages from the computers 33, 37 and 39 and/or remote computer-based systems can be displayed.

In the practice of the present invention, commercial components and subcomponents may be used to build the architecture of the system. For example, in use and operation, the invention may include processor boards, intelligent boards, unintelligent boards, a main board, microprocessors, a graphics system processor, an audio processor, the boards and components including memory in the form of ROM, RAM, Flash memory, EPROM, NVRAM and/or EEPROM (electrically erasable programmable read only memory). The central gaming control computer or the table game controller computer may include a system event controller, the random number generator, a win decoder/pay table, status indicators, a communications handler, encryption system for signals, hardware and peripherals (e.g., lights, displays, buttons, coin acceptors, key switches, doors switches, change systems, credit validators, play eporting systems, currency validators, hopper controls, diverters, lamps, auxiliary outputs, printers, handles, magnetic strip readers, optical scanners, credit card scanners, joy sticks, touchpads, wands, signal systems, and other active or interactive controls). Software may be provided with any operating system, either proprietary, public, open key or closed key such as the many variations of WINDOWS® operating systems, MAC® operating systems (e.g., MAC® OS), LINUX®, UNIX®, and the like.

The displays used on the various components may be in the form of monitors (i.e., CRT displays), plasma screens, light emitting diode (LED) panels, semiconductor displays, liquid crystal displays, and the like.

The description above is to be considered examples of the invention, and is not intended to limit the spirit or scope of the invention.

What is claimed is:

1. A method of controlling a live casino table card game in a gaming table environment, the gaming table environment comprising a gaming table, an automatic card shuffler comprising a processer, a local processor and a central control computer, the method comprising:

the shuffler processor sending information via a data connection to at least one of the local processor and the central control computer; and at least one of the local processor and the central control computer communicating information to the shuffler processor; wherein the automatic card shuffler responds to the information communicated to the shuffler processor.

2. The method of claim 1, further comprising providing at least one wager sensor, the at least one wager sensor sending information via a data connection to at least one of the local processor and the central control computer.

3. The method of claim 1, wherein information related to the automatic card shuffler operation is transmitted from the shuffler processor to at least one of the local processor and the central control computer.

4. The method of claim 1 wherein information sent from the shuffler processor includes at least one of a) datum relating to completion of a shuffling event, b) indication of a correct number of cards in a shuffler, c) jam of a shuffling event, d) insufficient or excessive cards in a shuffling event, e) a count of the total number of cards in the shuffler, f) a count of the total number of cards in a specific area within the shuffler, g) number of hands dealt to active players at a table, h) rank and/or suit of specific hands dealt at the table, i) hands achieving bonuses at the table, and j) indication of an excess of cards of specific rank and suit.

5. The method of claim 1, wherein all communication between the shuffler processor, local processor and the central control computer takes place in real time.

6. The method of claim 1, wherein all communication from at least one of the central control computer and the local processor is communicated through a data port in the shuffler.

7. The method of claim 1, wherein the communication from the at least one of the local processor and the central control computer controls at least one operation of the shuffler.

8. The method of claim 1, wherein information is provided from both the shuffler processor and the local processor computer in real time to the central control computer and the central control computer identifies or records at least one event selected from the group consisting of:

hands dealt per unit time;

identification of when a service call should be made;

automatic service call generation;

jam detection/recovery and reports of at least one of the jams and clears;

rounds of play per unit time;

the rank and suit of each card in the hand;

data on the amount of time an individual table is in use, the time of day an individual table is in use, specific information identifying individual tables from among a group of at least two tables, and the times when the tables are most filled;

an identification number corresponding to an individual shuffler is input into the local processor or the central control computer to track the location of each shuffler;

when individual shuffler information is input to the table game shuffler, this shuffler information is transmitted to the main controller either directly from the shuffler or into the local processor and then to the central control computer;

reports on shuffler swap outs are generated;

when the system is reading the rank and value of each card, the local processor is informed of the count or rank of each hand; and when the system has informed the local processor of the rank of each hand, specific awards are identified for each ranked hand meeting a minimum predetermined rank.

9. The method of claim 2, wherein a signal from the bet sensors is input into the shuffler itself to enable the shuffler to deal only the number of hands needed to cover bets.

10. A method of controlling a live casino table card game comprising:

providing a live gaming table with at least two player locations and at least one sensor in each player location for sensing bets;

providing a computer controlled automatic card-shuffling device;

providing a table game controller;

providing a central game controller; and electronically measuring betting information; and wherein the card-shuffling device receives game related data from at least one of the table game controller and the central game controller, responds to received game related data, and transmits data to at least one of the table game controller and central game controller in real time.

11. A method of controlling a live casino card game including: a security system for a casino table card game, the method comprising:

a) providing a casino table with i) indicia theron for the placement of wagers, ii) a data entry system with an associated local computer, and iii) sensors that can detect the placement of at least one specific category of wager;

b) shuffling cards with a mechanical shuffler with a shuffler process integral to the shuffler;

c) providing information to a central computer regarding at least one of the value of cards fed out of a section of the shuffler or a rank of hands provided to a player during a play of a card game or a suit of cards provided to the player; and d) the central computer receiving the information from the shuffler in real time, receiving information from the sensors, and receiving information from the data entry system; and the shuffler processor and the central computer communicating data among each other in real time, with data sent to the shuffler processor from the central computer.

12. A method of controlling a live casino table card game, comprising:

providing a live gaming table with at least two player locations and at least one sensor in each player location for sensing bets;

providing a computer controlled automatic card-shuffling device;

providing a table game controller;

providing a central game controller; and electronically measuring betting information; and wherein the card-shuffling device receives game related data from at least one of the table game controller and the central game controller, responds to received game related data, and transmits data to at least one of the table game controller and the central game controller in real time.

13. The method of claim 12, further comprising the step of the processor in the shuffler providing information to the external computer, the information being selected from the group consisting of occurrence of a card jam, occurrence of a jam recover and a number of times that a complete shuffler has been performed.

14. The method of claim 13, wherein the external computer processes information from the shuffler related to a single card game in real time.

15. The method of claim 13, and further comprising a central computer, wherein the central computer is in communication with at least one of the external computer and the shuffler processor, wherein the central computer processes information related to multiple card games.

16. The method of claim 13, wherein the information is one or more data types selected from the group consisting of: rank of hand, suit of a card, value of a card, number of cards present in the shuffler, number of cards present in one or more areas within the shuffler, and a number of complete shuffling sequences that have been performed.

17. The method of claim 13, wherein the external computer is directly linked to the processor via a date port in the shuffler.

18. The method of claim 12, further comprising activating an information display device in response to the information from the shuffler.

19. The method of claim 12, wherein the external computer processes information related to multiple card games.

20. The method of claim 1, wherein communication between at least two of the processor, local processor and central control computer is by way of a network connection.

21. The method of claim 1, wherein the information is transmitted to one or more of a local computer and a central computer.

* * * * *

UNITED STATES PATENT AND TRADEMARK OFFICE

CERTIFICATE OF CORRECTION

PATENT NO. : 8,337,296 B2
APPLICATION NO. : 09/967500
DATED : December 25, 2012
INVENTOR(S) : Attila Grauzer and David B. Lopez It is certified that error appears in the above-identified patent and that said Letters Patent is hereby corrected as shown below:

On the title page:

In ITEM (57) ABSTRACT: delete ABSTRACT and replace with the following:
--A security system for a casino table card game has a casino table with i) indicia thereon for the placement of wagers, ii) a data entry system with an associated computer, and iii) sensors that can detect the placement of at least one specific category of wager; a shuffling device with a microprocessor integral to the shuffler for providing information regarding cards or hands; a central table gaming computer that receives information from the shuffler in real time, receives information from the sensors, and receives information from the data entry system, the associated computer, the microprocessor and the central table gaming computer communicating data among each other in real time.--

In the specification:

| | | |
|---|---|---|
| COLUMN 3, | LINE 66, | change "(WO 97/10577)." to --(WO 97/010577).-- |
| COLUMN 8, | LINE 22, | change "systems-or" to --systems or-- |
| COLUMN 12, | LINE 47, | change "time," to --time.-- |
| COLUMN 13, | LINE 3, | change "pole the" to --poll the-- |
| COLUMN 13, | LINE 63, | change "table **20**" to --table **10**-- |
| COLUMN 14, | LINE 27, | change "the shuffler" to --the shuffling device **32**-- |
| COLUMN 14, | LINES 33, 34 | change "card shuffling or card randomizing" to --card-shuffling or card-randomizing-- |
| COLUMN 14, | LINE 40, | change "system includes" to --system **20** includes-- |
| COLUMN 15, | LINE 52, | change "play eporting" to --play reporting-- |

Signed and Sealed this
Twelfth Day of March, 2013

Teresa Stanek Rea
*Acting Director of the United States Patent and Trademark Office*

In the claims:

CLAIM 1, COLUMN 16, LINE 5, change “a processer,” to --a processor,--
CLAIM 10, COLUMN 17, LINE 29, change “and central” to --and the central--
CLAIM 11, COLUMN 17, LINE 33, change “theron” to --thereon--
CLAIM 11, COLUMN 17, LINE 43, change “during a” to --during--
CLAIM 12, COLUMN 18, LINES 1-15, delete claim 12 and replace with the following:

--12. A method of real-time data exchange in a casino card game, the method comprising:
providing an automatic card shuffler with a processor in the shuffler;
linking the shuffler processor to an external computer; and
transmitting data from the external computer to the shuffler processor, the data causing a change in operation by the shuffler.--

CLAIM 13, COLUMN 18, LINE 20, change “recover” to --recovery--
CLAIM 13, COLUMN 18, LINE 21, change “shuffler” to --shuffle--
CLAIM 15, COLUMN 18, LINE 27, change “and further” to --further--
CLAIM 16, COLUMN 18, LINE 33, change “ofhand,” to --of a hand,--
CLAIM 17, COLUMN 18, LINE 38, change “date port” to --data port--